US008410719B2

(12) United States Patent
Brueckel

(10) Patent No.: US 8,410,719 B2
(45) Date of Patent: Apr. 2, 2013

(54) ELECTRONIC BALLAST AND METHOD FOR CONTROLLING AT LEAST ONE LIGHT SOURCE

(75) Inventor: Martin Brueckel, Shenzhen (CN)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 113 days.

(21) Appl. No.: 12/864,253

(22) PCT Filed: Jan. 24, 2008

(86) PCT No.: PCT/EP2008/050812

§ 371 (c)(1),
(2), (4) Date: Jul. 23, 2010

(87) PCT Pub. No.: WO2009/092448

PCT Pub. Date: Jul. 30, 2009

(65) Prior Publication Data

US 2010/0295462 A1 Nov. 25, 2010

(51) Int. Cl.
*H05B 37/02* (2006.01)
*H05B 41/36* (2006.01)

(52) U.S. Cl. ..... 315/291; 315/209 R; 315/287

(58) Field of Classification Search ..... 315/209 R, 315/246, 287, 291, 307, 308
See application file for complete search history.

(56) References Cited

U.S. PATENT DOCUMENTS

| | | | | |
|---|---|---|---|---|
| 4,920,300 | A * | 4/1990 | Scott | 315/209 R |
| 5,552,748 | A | 9/1996 | O'Shaughnessy | |
| 6,552,498 | B1 | 4/2003 | Prasad et al. | |
| 7,102,452 | B1 | 9/2006 | Holmes | |
| 7,589,472 | B2 * | 9/2009 | Keith et al. | 315/94 |
| 2003/0001521 | A1 * | 1/2003 | Sheoghong | 315/291 |
| 2003/0062849 | A1 | 4/2003 | Prasad et al. | |
| 2003/0132799 | A1 | 7/2003 | Low et al. | |
| 2003/0137256 | A1 * | 7/2003 | Busse et al. | 315/209 R |
| 2004/0260500 | A1 | 12/2004 | Punzenberger et al. | |
| 2007/0152602 | A1 | 7/2007 | Nicolai | |
| 2007/0285185 | A1 | 12/2007 | Kwon et al. | |
| 2010/0259179 | A1 * | 10/2010 | Bowling et al. | 315/224 |

FOREIGN PATENT DOCUMENTS

| | | | |
|---|---|---|---|
| DE | 4301184 | A1 | 7/1994 |
| EP | 1806955 | A1 | 7/2007 |
| JP | 4112680 | A | 4/1992 |
| JP | 6197548 | A | 7/1994 |

(Continued)

OTHER PUBLICATIONS

DE4301184_EnglishAbstract.

(Continued)

*Primary Examiner* — Don Le

(57) ABSTRACT

An electronic ballast for driving at least one light source may include an input for connecting a supply voltage; an output configured to connect the at least one light source; an oscillator, which is designed to provide an oscillator output signal with a first frequency at its output, the oscillator having a calibration input in order to alter the first frequency; and a microcontroller configured to provide a drive signal with at least one spectral component at a second frequency for the at least one light source, the microcontroller being coupled to the oscillator output and being designed to generate the second frequency as a function of the first frequency; wherein the electronic ballast furthermore includes a drive circuit, which is coupled to the calibration input, the drive circuit being designed to vary the first frequency during running operation of the electronic ballast via the calibration input.

11 Claims, 1 Drawing Sheet

FOREIGN PATENT DOCUMENTS

| | | | |
|---|---|---|---|
| JP | 2001103765 | A | 4/2001 |
| JP | 2006191780 | A | 7/2006 |

OTHER PUBLICATIONS

International Search Report dated Nov. 3, 2008.

English Abstract JP6197548 A. Jul. 15, 1994.
English Abstract JP4112680 A. Apr. 14, 1992.
English Abstract JP2001103765 A. Apr. 13, 2001.
JEnglish Abstract JP2006191780 A. Jul. 20, 2006.

* cited by examiner

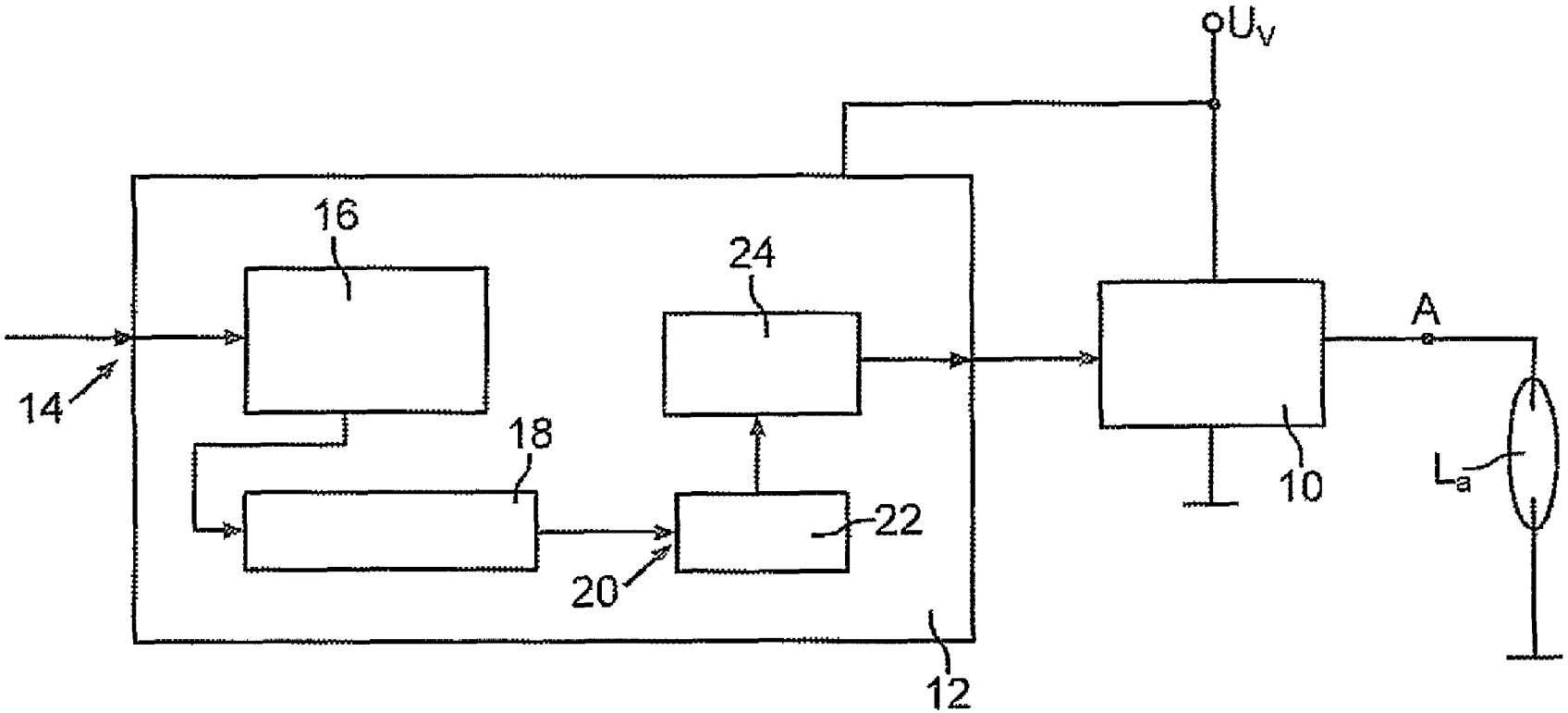
14
16
18
20
22
24
12
10
A
$U_V$
$L_a$

ELECTRONIC BALLAST AND METHOD FOR CONTROLLING AT LEAST ONE LIGHT SOURCE

RELATED APPLICATIONS

The present application is a national stage entry according to 35 U.S.C. §371 of PCT application No.: PCT/EP2008/050812 filed on Jan. 24, 2008.

TECHNICAL FIELD

Various embodiments provide an electronic ballast for driving at least one light source, the electronic ballast having an input for connecting a supply voltage, an output for connecting the at least one light source, an oscillator, which is designed to provide an oscillator output signal with a first frequency $f_{osc}$ at its output, the oscillator having a calibration input in order to alter the first frequency $f_{osc}$, and a microcontroller for providing a drive signal with at least one spectral component at a second frequency $f_{signal}$ for the at least one light source, the microcontroller being coupled to the oscillator output and being designed to generate the second frequency $f_{signal}$ as a function of the first frequency $f_{osc}$. Moreover, various embodiments provide for a method for driving at least one light source by means of a corresponding electronic ballast.

BACKGROUND

Various embodiments relate to the problem of generating a periodic signal, for example a PWM (=pulse width modulation) signal with a frequency $f_{signal}$ which is as high as possible and a frequency resolution which is as high as possible by means of a microcontroller using a frequency $f_{osc}$ which is as low as possible for an oscillator, which is coupled to the microcontroller.

In the field of lighting engineering, this problem occurs, for example, when starting a discharge lamp. That is to say that a high voltage which is generated by resonance is required for starting the discharge lamp. In the case of a conventional and inexpensive method, the resonant frequency or a harmonic of the resonant frequency of a resonant circuit is excited for this purpose. In order to blank all of the tolerances of the resonant circuit, the frequency is varied, i.e. swept. In order to meet the maximum which is subject to tolerances with a maximum error which is as low as possible, the resolution of the frequency increments needs to be correspondingly high. In another application, the switching frequency of the lamp current is varied in order to avoid resonant effects in the lamp. In another application, the switching frequency in an electronic circuit is varied in order to make the electric magnetic interference emission more broadband than in the case of a fixed switching frequency.

Time-dependent periodic signals are often generated by means of a microcontroller. In the process, the microcontroller is often clocked by an oscillator at a fixed frequency $f_{OSC}$. By virtue of internal meters, for example so-called PWM units, periodic signals with a frequency $f_{signal}$ which can be set or an on and off time which can be set can be generated therefrom and emitted by the microcontroller. In the prior art, the higher the frequency $f_{signal}$ of a signal to be generated at a fixed available oscillator frequency $f_{OSC}$, the lower the relative frequency resolution of the periodic signal to be generated will be.

One example will be used to explain this: the oscillator frequency $f_{OSC}$ is 10 MHz, i.e. one period of oscillation is 100 ns. In the case of a signal to be generated with the frequency $f_{signal}$=10 kHz, a period of oscillation comprises 100 μs. Therefore, a period of oscillation comprises 1000 ticks of the clock of the oscillator frequency. The relative frequency resolution is thus 1/1000=0.1%. If, however, a signal with a frequency $f_{signal}$ of 1 MHz is to be generated, the period of oscillation is 1 μs and therefore now only 10 ticks of the clock predetermined by the oscillator frequency $f_{OSC}$. The relative frequency resolution is therefore reduced to 1/10=10%. In the prior art, therefore, the relative resolution is proportional to the ratio of $f_{OSC}/f_{signal}$. The lower this ratio is, the lower the relative frequency resolution is in the signal to be generated.

In the prior art, therefore, an oscillator with a frequency $f_{OSC}$ is selected, whose resolution $1/f_{OSC}$ is sufficiently fine for the required resolution for the signal with the frequency $f_{signal}$ to be generated. If, for example, a signal with $f_{signal}$ equal to 100 kHz and a resolution of 1%, i.e. the frequency can be set in 1% increments, is made available, an oscillator with an oscillator frequency of 100 kHz/1%=10 MHz is selected in the prior art.

The oscillator which is already provided as standard in a microcontroller with the frequency $f_{OSC}$ is often used in order to generate a signal with the frequency $f_{signal}$ by the microcontroller. Correspondingly, the selection of the microcontroller is often geared to the integrated oscillator. In order to provide signals with a high frequency $f_{signal}$ at the output of the microcontroller and, in addition to this, with a high resolution, it is therefore often necessary to deviate in favor of well equipped and therefore expensive microcontrollers.

It is known from the prior art to set the frequency $f_{OSC}$ of the signal which is made available by an oscillator via the calibration input of the oscillator. This is carried out once, before an electronic ballast provided therewith is first used and is used for the purpose of ensuring that different electronic ballasts provide comparable signals for the light sources to be connected thereto at the output of said ballasts.

DE 43 01 184 A1 has disclosed a control device for at least one discharge lamp, which control device has an inverter which is connected to a DC voltage source for changing, at a low frequency, the direction of current flow through the discharge lamp and a power controller, which is connected to a current sensor. The oscillator for the high frequency can be altered in terms of its high frequency by a control signal during operation, with it being possible, as a result, for the current flowing through an inductance and the discharge lamp to be switched on and off and to be kept constant by virtue of regulation of the pulse width of the resultant current. By virtue of the alteration of the high frequency of the oscillator, it is possible in this way to avoid instabilities which occur as a result of resonance phenomena. The oscillator is a conventional VCO (Voltage Controlled Oscillator), in which the frequency output thereby can be altered by varying the voltage applied to its control input. In addition to the control input, a VCO has a calibration input, with which the dependency between the applied voltage and the output frequency can be set. The problems mentioned at the outset result with such a control device.

SUMMARY

Various embodiments develop an electronic ballast mentioned at the outset or a method mentioned at the outset such that a signal with a frequency $f_{signal}$ which is as high as possible and/or a frequency resolution which is as high as possible can be generated using a given oscillator with an oscillator frequency $f_{osc}$ by the microcontroller coupled thereto.

Various embodiments are based on the knowledge that, in order to achieve the above-defined object, the calibration input of the oscillator can be used in optimum fashion if said calibration input is correspondingly driven during running operation of the electronic ballast. According to various embodiments, the electronic ballast furthermore has a drive circuit, which is coupled to the calibration input, the drive circuit being designed to vary the first frequency $f_{osc}$ during running operation of the electronic ballast via the calibration input.

The frequency $f_{signal}$ of the periodic signal generated by the microcontroller is therefore set, altered or adjusted finely during running operation by changing, i.e. recalibrating, the frequency $f_{OSC}$ of the oscillator during running operation. The resolution which can be achieved thereby when setting the frequency $f_{signal}$ of periodic signals is in particular independent of the ratio of the frequency $f_{OSC}$ of the oscillator to the frequency $f_{signal}$ of the signal to be generated by the microcontroller. It is now only dependent on the resolution with which the frequency $f_{OSC}$ of the oscillator itself can be altered.

If, for example, a signal with a frequency $f_{signal}$=100 kHz and a resolution of 1% is intended to be generated, as in the example above, in the extreme case an oscillator with a frequency $f_{OSC}$ of 100 kHz can be selected if the oscillator can be calibrated in 1% increments during running operation. This results in significantly lower demands being placed on the frequency $f_{OSC}$ of the oscillator than in the prior art.

By using an oscillator for making available a low frequency $f_{OSC}$, cost savings can be made when implementing the same result as in the prior art. In particular, it is possible to use a microcontroller with reduced capabilities for generating time-dependent signals since, for example, no internal PLL (Phase Locked Loop) is required for generating a high intermediate frequency and the resolution of internal timer functions can be lower. A cost saving of from 20 to 40% can thus be realized with the microcontroller. In particular, the present invention makes it possible to use the internal RC oscillator of a micro-controller for many applications instead of an external oscillator, which may be required in the prior art, in order to provide higher oscillator frequencies $f_{OSC}$ than those which are possible with the internal RC oscillator.

Nevertheless, the present invention can be implemented with the internal oscillator of a microcontroller or with an external oscillator of a microcontroller.

Moreover, the present invention makes it possible to reduce the current consumption of the oscillator since this current consumption generally increases with the frequency $f_{OSC}$.

The tolerance of the frequency of an oscillator which can be calibrated is generally higher than that of an oscillator, i.e. quartz or resonator, with a fixed frequency. Therefore, the present invention can be used particularly advantageously when the precise absolute value of a set frequency $f_{signal}$ can have the corresponding frequency, but it is necessary to ensure that a specific frequency range with a specific resolution is covered by a time-dependent signal to be generated (as is the case in the exemplary embodiments mentioned at the outset).

In accordance with a first preferred embodiment, the oscillator is coupled to the microcontroller in such a way that it clocks the microcontroller. Alternatively, it can be provided that the microcontroller comprises a timer apparatus, in particular a pulse width modulation apparatus, which is designed to provide the drive signal, the oscillator being coupled to the microcontroller in such a way that it clocks the timer apparatus. In this case, for example, the output compare value or the prescaler value of the timer apparatus can be changed.

Preferably, the electronic ballast includes a calibration register, which is coupled to the oscillator. It is further preferred in this case if a predeterminable value can be set in the calibration register, the calibration register being designed for a change in the predeterminable value during running operation of the electronic ballast. As a result, the frequency $f_{OSC}$ and therefore the frequency $f_{signal}$ can be changed in a particularly simple manner.

Preferably, the predeterminable value can be changed in increments of 0.5% to 10%. A frequency resolution which is sufficiently fine in most applications can therefore be achieved.

In order to produce a start value again, if required, the calibration register can be designed to store at least one predeterminable value. As an alternative or in addition, it can also be provided that the value of the calibration register is stored, in which a resonance has been fixed, for example in order to avoid said resonance (acoustic resonance) or to set said resonance (starting resonance).

Preferably, the ratio of $f_{signal}$ to $f_{OSC}$ is between 1:1 and 100:1.

In accordance with a first preferred embodiment, the oscillator is provided in the microcontroller, as has already been mentioned. In accordance with a second preferred embodiment, however, the oscillator can also be provided outside the microcontroller.

The preferred embodiments proposed with reference to the electronic ballast according to the invention and the advantages thereof apply correspondingly, if appropriate, to the method according to the invention.

BRIEF DESCRIPTION OF THE DRAWING(S)

An exemplary embodiment of an electronic ballast according to the invention will now be described in more detail below with reference to the attached drawing, which shows a schematic illustration of an exemplary embodiment of an electronic ballast according to the invention.

DETAILED DESCRIPTION

The following detailed description refers to the accompanying drawings that show, by way of illustration, specific details and embodiments in which the invention may be practiced.

FIG. 1 shows a schematic illustration of the design of an electronic ballast according to the invention. Said electronic ballast includes a block 10, in which the elements which are less at the foreground in terms of the present invention and have long been known to a person skilled in the art are combined. These elements are, for example, elements for radio interference suppression, for rectification, for power factor correction, a bridge circuit, coupling and resonant capacitors, a lamp inductor or the like. A light source La, in this case a discharge lamp, is connected to the output A of the block 10. The invention can easily be transferred to other types of light sources. The electronic ballast illustrated in FIG. 1 includes a supply voltage terminal $U_v$, which is coupled firstly to the block 10 and secondly to a microcontroller 12. The microcontroller 12 includes an interface 14, via which access to a drive circuit 16 is made possible. The drive circuit 16 is coupled to a calibration register 18 and is designed to vary the entry in calibration register 18 during running operation of the electronic ballast. The calibration register 18 is coupled to the calibration input 20 of an oscillator 22, which provides a signal with a frequency $f_{OSC}$ to a timer apparatus 24 as a function of the signal applied to its input 20. The timer apparatus can in particular represent a pulse width modulation apparatus.

The timer apparatus 24 provides a drive signal with at least one spectral component at the frequency $f_{signal}$ for the at least one light source at its output, which is coupled to the output of the microcontroller 12, the timer apparatus generating the frequency $f_{signal}$ as a function of the frequency $f_{OSC}$, which has long been known to a person skilled in the art.

While the oscillator 22 is part of the microcontroller 12 in the exemplary embodiment illustrated, the oscillator 22 can also be arranged outside the microcontroller 12 in order to drive the microcontroller 12. While the oscillator 22 clocks the timer apparatus 24 in the exemplary embodiment illustrated, provision can also be made for the oscillator 22 to clock the microcontroller 12 itself, for example via a clock input of the microcontroller 12.

It is therefore possible, using the drive circuit 16, which is coupled to the calibration input 20 of the oscillator 22 via the calibration register 18, to alter the frequency $f_{signal}$ of the signal provided at the output of the microcontroller 12 during running operation of the electronic ballast via the interface 14. The provided signal at the output of the microcontroller 12 can be used, for example, to drive the switches in a half-bridge circuit, whose half-bridge center point is coupled to the output A in order to drive the lamp La.

In addition to the advantages already mentioned above, the invention can also be used when setting a sequence of light changes with a high temporal resolution, for example via a color wheel in projection lamps. It is likewise possible in the case of LED projection or in the case of LED backlighting for the different light levels to be controlled with a high degree of temporal resolution and using an extremely inexpensive microcontroller.

The microcontroller illustrated in FIG. 1 may be an ATMEL microcontroller of the AVR family, for example. This includes an RC oscillator, with it being possible for individual capacitors and nonreactive resistors of the oscillator to be connected or disconnected via a calibration register 18. According to the invention, this is brought about during running operation via the calibration input 20 of the oscillator 22.

While the invention has been particularly shown and described with reference to specific embodiments, it should be understood by those skilled in the art that various changes in form and detail may be made therein without departing from the spirit and scope of the invention as defined by the appended claims, The scope of the invention is thus indicated by the appended claims and all changes which come within the meaning and range of equivalency of the claims are therefore intended to be embraced.

The invention claimed is:

1. An electronic ballast for driving at least one light source, the electronic ballast comprising:

an input for connecting a supply voltage;

an output configured to connect the at least one light source;

an oscillator, which is designed to provide an oscillator output signal with a first frequency at its output, the oscillator having a calibration input in order to alter the first frequency; and a microcontroller configured to provide a drive signal with at least one spectral component at a second frequency for the at least one light source, the microcontroller being coupled to the oscillator output and being designed to generate the second frequency as a function of the first frequency;

wherein characterized in that the electronic ballast furthermore comprises a drive circuit, which is coupled to the calibration input, the drive circuit being designed to vary the first frequency during running operation of the electronic ballast via the calibration input, and wherein the electronic ballast comprises a calibration register, which is coupled to the oscillator.

2. The electronic ballast as claimed in claim 1, wherein the oscillator is coupled to the microcontroller in such a way that it clocks the microcontroller.

3. The electronic ballast as claimed in claim 1, wherein the microcontroller comprises a timer apparatus, in particular a pulse width modulation apparatus, which is designed to provide the drive signal, the oscillator being coupled to the microcontroller in such a way that it clocks the timer apparatus.

4. The electronic ballast as claimed in claim 1, wherein a predeterminable value can be set in the calibration register, the calibration register being designed for a change in the predeterminable value during running operation of the electronic ballast.

5. The electronic ballast as claimed in claim 4, wherein the predeterminable value can be changed in increments of 0.5% to 10%.

6. The electronic ballast as claimed in claim 1, wherein the calibration register is designed to store at least one predeterminable value.

7. The electronic ballast as claimed in claim 1, wherein the ratio of fsignal/fOSC is between 1:1 and 100:1.

8. The electronic ballast as claimed in claim 1, wherein the oscillator is provided in the microcontroller.

9. The electronic ballast as claimed in claim 1, wherein the oscillator is provided outside the microcontroller.

10. A method for driving at least one light source by means of an electronic ballast with an input for connecting a supply voltage; an output configured to connect the at least one light source; an oscillator, which is designed to provide an oscillator output signal with a first frequency at its output, the oscillator having a calibration input in order to alter the first frequency; a microcontroller configured to provide a drive signal with at least one spectral component at a second frequency for the at least one light source, the microcontroller being coupled to the oscillator output and being designed to generate the second frequency as a function of the first frequency, and a calibration register coupled to the oscillator;

the method comprising:

varying the first frequency during running operation of the electronic ballast by means of a drive circuit, which is coupled to the calibration input.

11. The electronic ballast as claimed in claim 3, wherein the timer apparatus is a pulse width modulation apparatus.

* * * * *